US005913582A

United States Patent [19]

Coonan

[11] Patent Number: 5,913,582

[45] **Date of Patent: *Jun. 22, 1999**

[54] COMPUTER WORKSTATION

[76] Inventor: Gary M. Coonan, 1420 Trotters La., Rockvale, Tenn. 37129

[ * ] Notice: This patent is subject to a terminal disclaimer.

[21] Appl. No.: 08/869,103

[22] Filed: Jun. 4, 1997

Related U.S. Application Data

[63] Continuation-in-part of application No. 08/727,372, Oct. 8, 1996, Pat. No. 5,758,935.

[51] Int. Cl.[6] ..... A47B 81/00

[52] U.S. Cl. ..... 312/223.3; 312/249.11

[58] Field of Search ..... 312/194, 208.1, 312/213, 223.3, 7.2, 282, 249.8, 249.11, 223.6, 249.12, 249.13, 351.13; 108/50.01, 50.02; 248/917

[56] References Cited

U.S. PATENT DOCUMENTS

| | | | |
|---|---|---|---|
| 2,044,559 | 6/1936 | Balster . | |
| 2,841,410 | 7/1958 | Kessler, Jr. et al. . | |
| 2,879,561 | 3/1959 | Reider | 292/87 X |
| 3,541,256 | 11/1970 | Anders . | |
| 3,940,136 | 2/1976 | Runte . | |
| 4,073,556 | 2/1978 | Wilson, Jr. . | |
| 4,440,457 | 4/1984 | Fogelman et al. . | |
| 4,640,199 | 2/1987 | Zigman . | |
| 4,668,026 | 5/1987 | Lapeyre et al. . | |
| 4,828,340 | 5/1989 | Jorgensen . | |
| 4,828,342 | 5/1989 | Stefan . | |
| 5,033,804 | 7/1991 | Faris . | |
| 5,071,204 | 12/1991 | Price et al. . | |
| 5,072,999 | 12/1991 | Trotta et al. . | |
| 5,087,010 | 2/1992 | Walters . | |
| 5,118,172 | 6/1992 | Ugalde . | |
| 5,120,117 | 6/1992 | Williams . | |
| 5,259,668 | 11/1993 | Teufel et al. | 312/249.12 X |
| 5,271,669 | 12/1993 | Pearlson . | |
| 5,290,099 | 3/1994 | Lechman . | |
| 5,364,177 | 11/1994 | Ugalde . | |
| 5,393,025 | 2/1995 | Franklin . | |
| 5,403,082 | 4/1995 | Kramer . | |
| 5,450,800 | 9/1995 | Leonard . | |
| 5,480,224 | 1/1996 | Ugalde . | |
| 5,489,938 | 2/1996 | Maruyama et al. . | |
| 5,518,310 | 5/1996 | Ellman et al. . | |
| 5,655,822 | 8/1997 | Roberts et al. | 312/223.3 X |

*Primary Examiner*—Peter M. Cuomo
*Assistant Examiner*—Janet M. Wilkens
*Attorney, Agent, or Firm*—Michael McNeil

[57] ABSTRACT

A portable computer workstation for ergonomic use in crowded work settings such as hospitals, factories, laboratories and automobile service facilities, is described. The workstation includes a rectangularly shaped box cabinet with a keyboard drawer slidably mounted to it. A window assembly is mounted to the top of the cabinet. The window assembly enables an external user to view a computer monitor that is mounted within the cabinet under the window. The window protects the computer monitor from chemical spills and other potentially damaging contaminants. The cabinet is also preferably mounted on four lockable casters so that the same can be moved easily from one location to another. When the keyboard drawer is concealed within the cabinet, the workstation preferably takes up only a small amount of floor space and presents a substantially smooth catch-free and easily cleanable exterior surface.

20 Claims, 9 Drawing Sheets

COMPUTER WORKSTATION

RELATION TO OTHER PATENT APPLICATION

This application is a continuation-in-part of application Ser. No. 08/727,372, filed Oct. 8, 1996, now U.S. Pat. No. 5,758,935 and entitled "Computer Workstation".

TECHNICAL FIELD

The present invention relates generally to computer workstations, and more particularly to a relatively compact computer workstation designed to be ergonomically used by a standing person in a crowded work setting.

BACKGROUND OF THE INVENTION

People who work on their feet in crowded and cramped environments have special needs with regard to a computer workstation. A few examples of such work places include hospitals, factories, laboratories, and automobile service facilities. In these environments, a computer workstation needs to be portable and yet stable. It needs to maintain a small footprint in order to decrease the amount of floor space utilized, yet be ergonomically designed for use by a standing individual. Furthermore, the various computer input (e.g. keyboard) and output devices (e.g. computer monitor) should be accessible and visible, yet have the ability to be protected from damage from contaminants, collisions, etc. in an environment that can be hostile to sensitive computer related equipment.

What is needed is a computer workstation designed for a work environment that is crowded, cramped, and often subjects the computer system housed within the workstation to harmful conditions, such as chemical spills and exposure to other potential contaminants.

SUMMARY OF THE INVENTION

In one embodiment, a computer workstation includes a cabinet having a top that includes a horizontal substantially leak-proof window. A computer monitor is mounted in the cabinet under the window. A computer input device, such as a keyboard, is supported by the cabinet and movable between a concealed position inside the cabinet and an exposed position.

In another embodiment, a computer workstation includes a rectangularly shaped cabinet having a bottom and a top that includes a horizontal substantially leak-proof window. A plurality of casters are attached to the bottom of the cabinet. A computer monitor is mounted in the cabinet under the window. A computer input device is supported by the cabinet and movable between a concealed position inside the cabinet and an exposed position. The computer workstation occupies less than about three and a half square feet of floor space when the computer input device is in its concealed position.

In still another embodiment of the present invention, a computer workstation includes a rectangularly shaped cabinet having an exterior, a bottom and a top that includes a horizontal substantially leak-proof window. A plurality of lockable casters having a diameter greater than about two and a half inches are attached to the bottom of the cabinet. A plurality of bumpers are attached to the exterior of the cabinet. A computer monitor is mounted in the cabinet under the window. A computer input device is supported by the cabinet and moveable between a concealed position inside the cabinet and an exposed position. The computer workstation occupies less than about three and a half square feet of floor space when the computer input device is in its concealed position. The exterior of the cabinet presents a smooth, catch-free surface when the computer input device is in its concealed position.

DESCRIPTION OF THE PREFERRED EMBODIMENT

Figure 1:
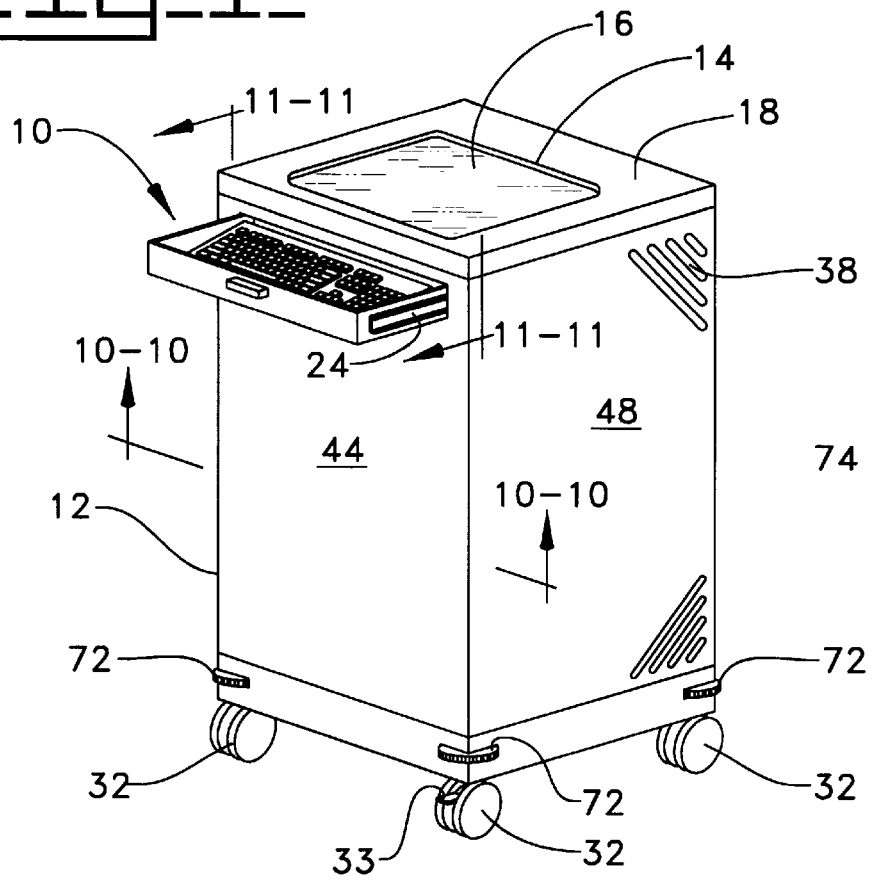
FIG. 1 is a perspective view of a computer workstation according to one embodiment of the present invention.

Referring now to the drawings, wherever like reference numerals are used, they are intended to refer to identical features throughout all of the drawings. Computer workstation 10 includes a cabinet 12, a window assembly 14, a keyboard drawer 20, a monitor mounting shelf 28 and casters 32. Cabinet 12 is preferably a rectangularly shaped box that includes a vertical front side 44, a vertical rear side 46 about equal in vertical surface area to front side 44, a vertical right side 48, a vertical left side 50, a square horizontal base 52, and a square horizontal top or window assembly 14, whose orientation is angularly fixed and/or non adjustable. Each of the sides and base are preferably formed from a suitable sheet metal material into panels and then attached to one another in any one of several methods known in the art.

Figure 2:
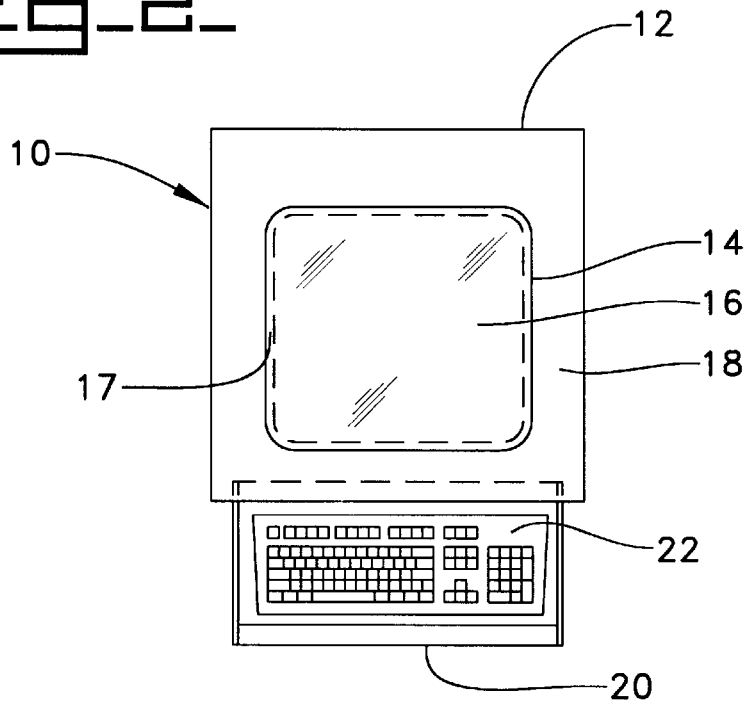
FIG. 2 is a top view of the computer workstation shown in FIG. 1.

Window assembly 14 is mounted along the top edges 13 of each of the respective sides 44, 46, 48 and 50 of cabinet 12. Window assembly 14 includes a window 16 and a frame 18, which like the sides is preferably formed from a suitable piece of sheet metal. Window 16 is preferably flush mounted within frame 18 to prevent leaks from entering the interior of cabinet 12. A continuous silicon bead 17 (FIG. 2) is placed between window 16 and frame 18 to enhance leak prevention. By the term "substantially leak-proof" as used herein and in the claims, it is intended to mean that window assembly 14 prevents leakage of practically all liquids or other spills that may occur on window assembly 14 into the interior of the cabinet. However, this is not intended to mean or require that absolutely no liquids can enter the interior of cabinet 12. Window 16 is preferably made from a durable material, such as polycarbonates, including but not limited to LEXAN® transparent plastic, or a suitable tempered glass that is impact resistant and chemical resistant for easy cleaning.

Figure 5:
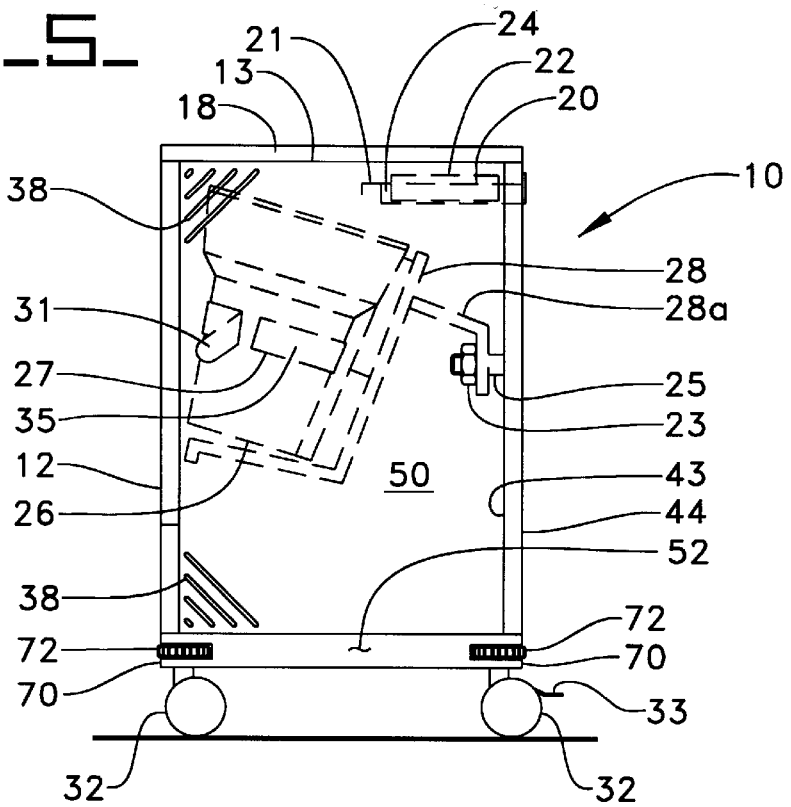
FIG. 5 is a left side elevational view of the computer workstation shown in FIG. 1.
Figure 6:
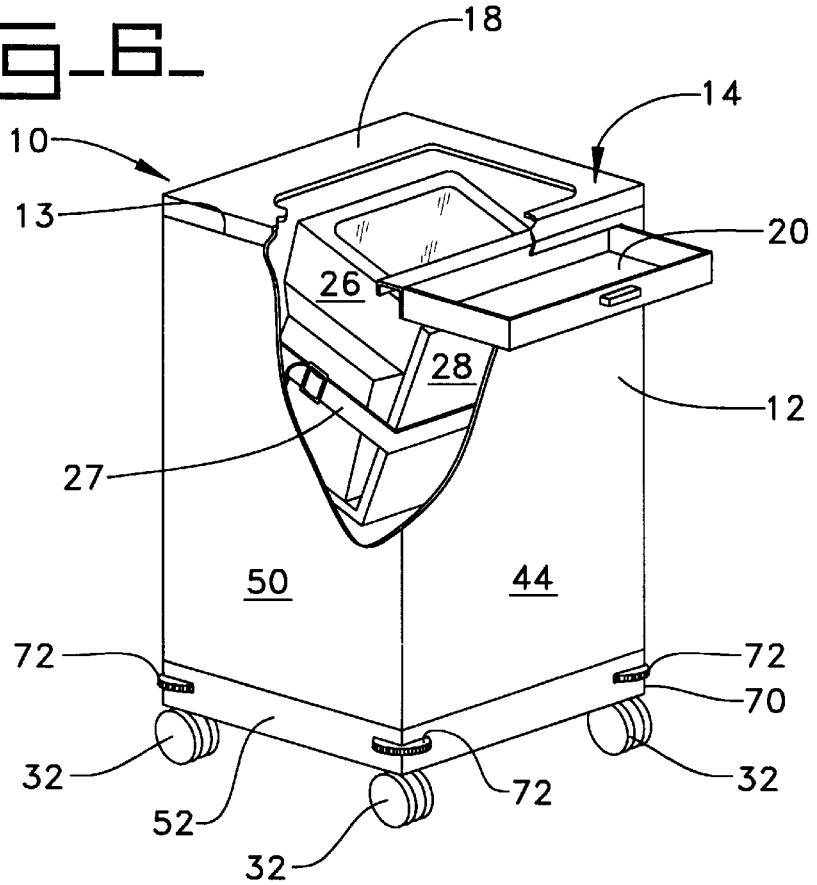
FIG. 6 is a partially cut away perspective view of a computer workstation according to the present invention.

As best seen in FIGS. 1, 5 and 6, keyboard drawer 20 supports a suitable computer input device, such as keyboard 22, but might also support other input devices such as a track ball, mouse, etc. Keyboard drawer 20 is mounted to a ball bearing slide 20 so that it slides into and out of cabinet 12 between a concealed position and an exposed position, respectively. Those skilled in the art will appreciate that a hinged keyboard support could be substituted for drawer 20 and still be considered an input support portion of cabinet 12 that is moveable between a concealed position and an exposed position. Keyboard 22 is protected from damage from chemical spills and other contaminates when in its concealed position within cabinet 12. Keyboard 22 is positioned lower than window assembly 14 but higher than a portion of view screen 34 (See FIGS. 13*a* and 13*b*) of computer monitor 26 when in both its concealed and exposed positions. In this embodiment, drawer slide 24 includes a catch 21 (FIG. 6) that secures drawer 20 when opened by catching onto the top edge 13 of front side 44. In some embodiments, it might also be desirable to include a lock on keyboard drawer 20 in order to prevent access to keyboard 20 by unauthorized users.

Figure 3:
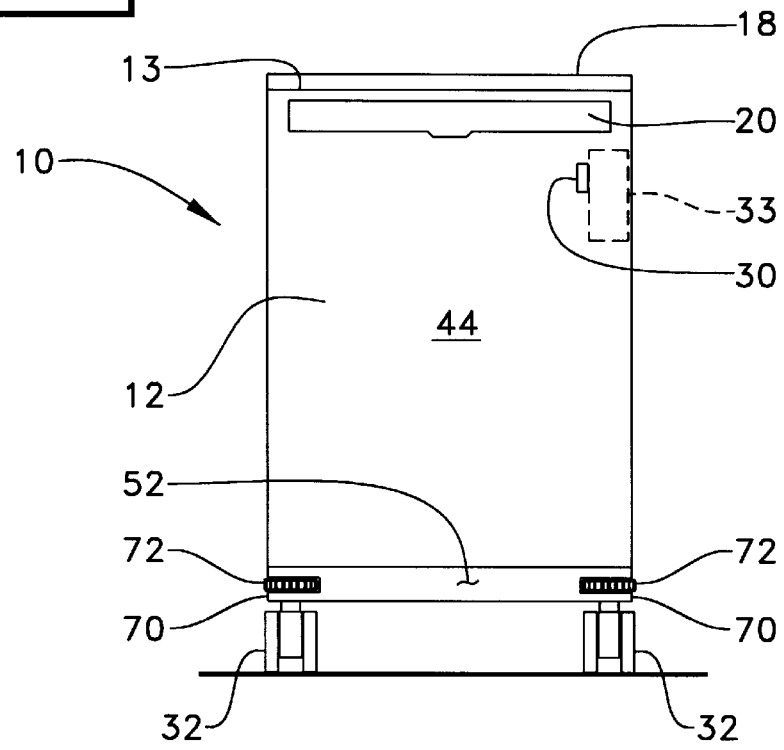
FIG. 3 is a front elevational view of the computer workstation shown in FIG. 1.

As best seen in FIGS. 1, 3 and 5, casters 32 are mounted at each corner 70 of base 52. Casters 32 include ball bearings and are preferably of a relatively large diameter, greater than 2½ inches such as three to four inches, and are preferably extra wide, such as about two and a half inches, to decrease the amount of effort required to move workstation 10 over rough floors, through doorway thresholds, over carpet edges and into and out of elevators. The larger diameter casters allow an individual to push workstation 10 over these irregular surfaces while lowering the risk that workstation 10 will tip over when bumps are encountered. Thus, the larger diameter casters improve the stability of workstation 10, especially when it is being moved from one location to another over irregular surfaces. Casters 32 are preferably made from a wear resistant material, such as polyurethane, and preferably include locking mechanisms 33 so that workstation 10 can be locked in place for stationary use, even on an inclined surface. The preferred locking mechanism prevents casters 32 from turning and from swiveling, and suitable examples can be obtained from Jilson Manufacturing, 20 Industrial Road, Lodi, N.J. 07644, part no. 1EB100MA-EUGR-Q20NQQ.

Continuing on to FIGS. 1, 3, 4 and 5, each corner 70 of cabinet 12 has a bumper 72 attached thereto. The outer surface of bumpers 72 define the outer perimeter of computer workstation 10. Bumpers 72 enable the user to move workstation 10 from place to place in a way that both protects sensitive computer equipment carried by the computer workstation and other surrounding equipment, walls, etc. from damage when inevitable minor collisions occur. In other words, cabinet 12 and the contained computer equipment as well as other surrounding equipment and walls are somewhat protected by the cushioning effect of bumpers 72 when inevitable bumps occur during movement of computer workstation 10 from one place to another.

Figure 4:
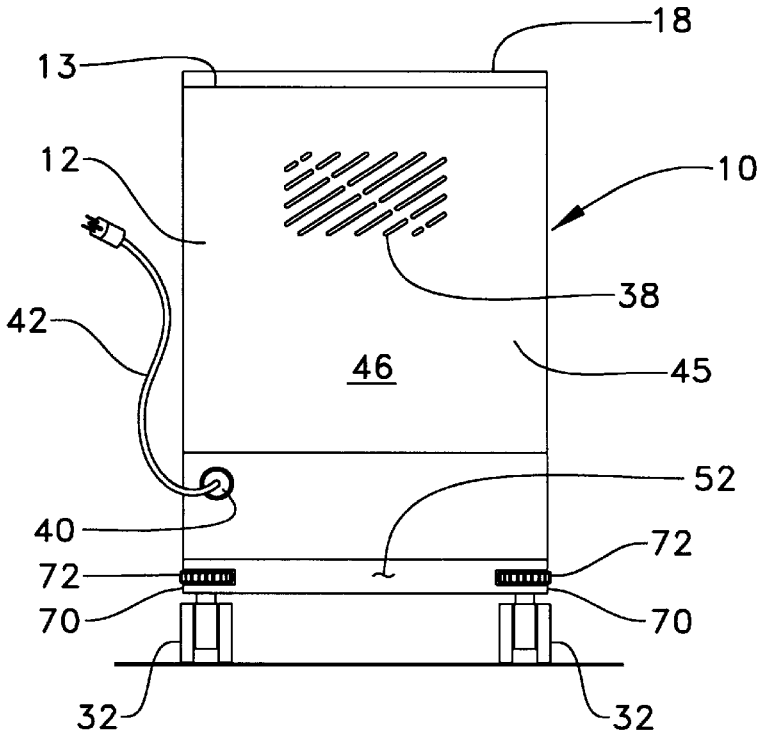
FIG. 4 is a rear elevational view of the computer workstation shown in FIG. 1.

As best seen in FIGS. 1, 4 and 5, at least one side of cabinet 12 includes cooling vents 38 that enable the electronic equipment contained within cabinet 12 to be ventilated. Additionally, cabinet 12 has an outer surface that includes a powder coating 74. Powder coating 74 should be such that it will not easily chip or scratch, and should be substantially impervious to harsh chemicals that may be encountered in the workstation's particular environment. As stated earlier, cabinet 12 is preferably made from a plurality of formed steel sheet metal panels, and powder coating 74 is applied to cabinet 12 either before or after the sides are assembled together.

Referring now to FIG. 4, the back side 46 of workstation 10 includes a portal 40 for a power cord 42 and any other cords that facilitate connection of workstation 10 to an external CPU. Preferably, power cord 42 is attached to an outlet box 33 (FIG. 3) that is mounted and concealed within cabinet 12. Thus, the electrical equipment within computer workstation 10 is plugged into the outlet box contained within cabinet 12, and power is supplied to that outlet box by plugging power cord 42 into any available wall outlet. This enables additional electrical equipment to be installed in cabinet 12 as well as facilitating the replacement of original equipment. Furthermore, this feature enables the user to move the workstation from one data entry point to the next in a very efficient manner.

Back side 46 of workstation 10 also includes a rear door 45. Rear door 45 is preferably mounted to cabinet 12 using hinges, magnetic connections or any other conventional means. Rear door 45 can be opened and/or removed so that a user can access the interior of cabinet 12 to install and/or secure a computer monitor 26 as described below, or to otherwise manipulate the computer equipment positioned within cabinet 12. Rear door 45 can also include a lock in order to secure the contents of workstation 10.

Referring now particularly to FIG. 5, a fastener 25 that includes a threaded stud is welded to the inside surface 43 of front side panel 44. A shelf 28 is mounted within cabinet 12 by attaching shelf extension 28*a* to threaded stud 25 using a conventional nut 23. Thus, shelf 28 is mounted using a fastener that is concealed within cabinet 12. A computer monitor 26 is secured to shelf 28 using a belt 27, preferably made from nylon or another suitable material. Belt 27 includes hooks 31 on a portion of one side and eyes 35 on a portion of an other side, as commonly marketed as VELCRO® hook and loop fasteners. This flexibility allows workstation 10 to accommodate various makes and sizes of computer monitors 26. When mounted, belt 27 is looped around monitor 26, pulled snug, and secured back on itself to hold monitor 26 in place on shelf 28. Computer monitor 26 is mounted in, and surrounded by, the cabinet, and is positioned under window 16, so that the same can be viewed from outside of workstation 10. Computer monitor 26 is mounted at an angle with respect to window assembly 14 in order to further accommodate external viewing from a person standing in front of workstation 10.

As best seen in FIG. 3, the front side panel 44 of work station 10 includes a power switch 30, which is positioned adjacent the internally mounted outlet box 31. Power switch 30 turns on and off power to outlet box 31 when power cord 42 is plugged into a wall outlet. Thus, when computer monitor 26 is plugged into outlet box 31, power switch 30 can operate to turn the monitor on and off. In addition, power switch 30 can also operate additional electrical equipment when alternative embodiments of workstation 10 are used. The present invention preferably has an operating temperature range from 20° below zero Fahrenheit up to about 80° Fahrenheit, and the electrical equipment is preferably powered by a conventional 120 volt outlet at 10 amps.

Figure 7:
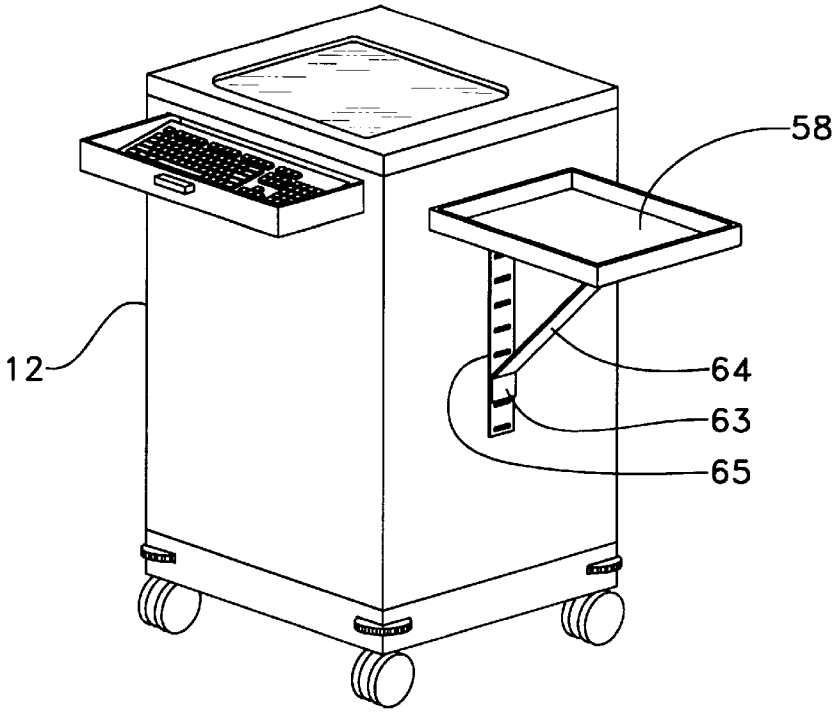
FIG. 7 is a perspective view of a computer workstation according to another embodiment of the present invention.
Figure 8:
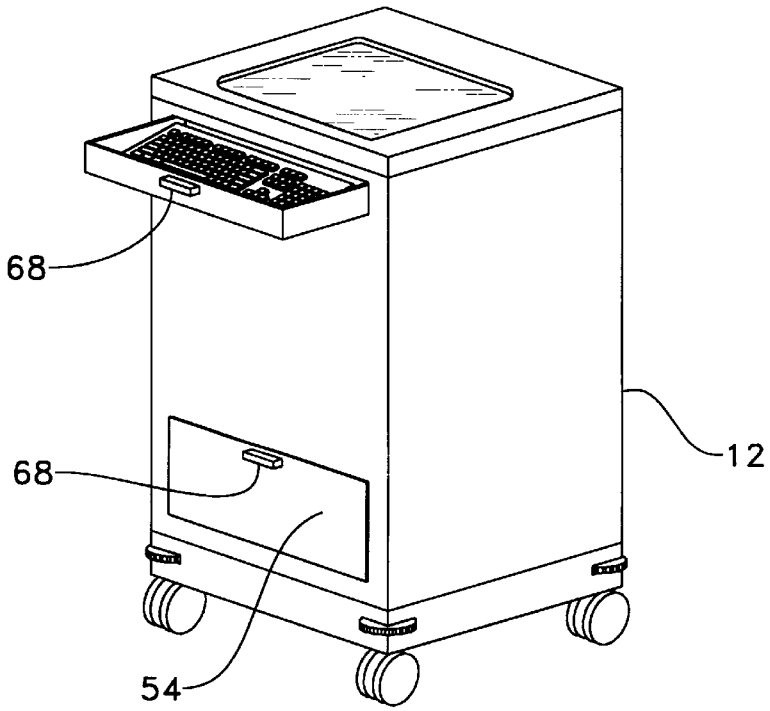
FIG. 8 is a perspective view of a computer workstation according to still another embodiment of the present invention.
Figure 9:
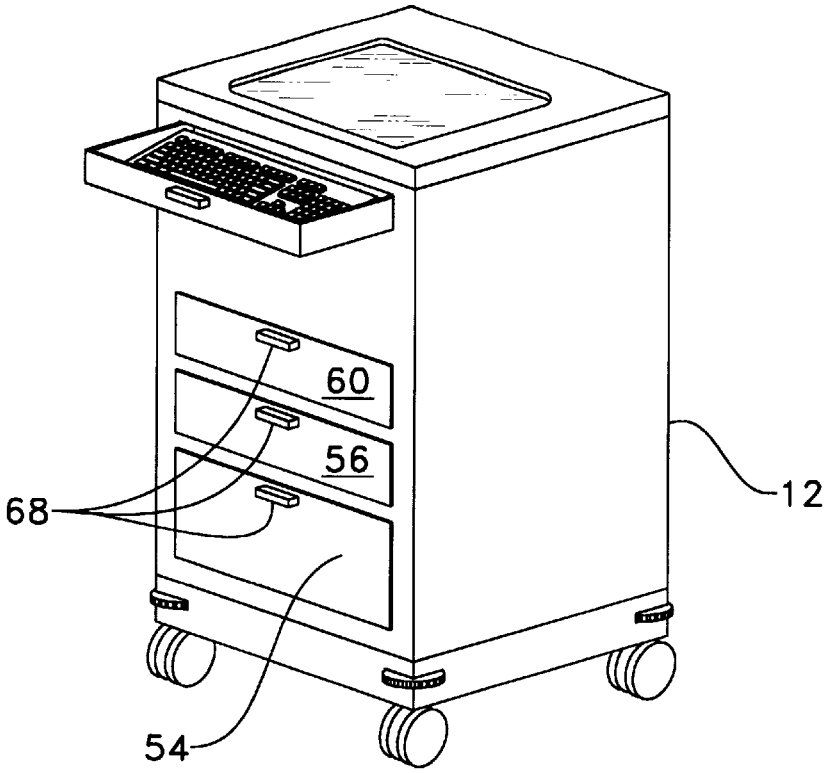
FIG. 9 is a perspective view of a computer workstation according to another embodiment of the present invention.

Referring now to FIG. 7, 8, 9 and 15, alternative embodiments of computer workstation 10 are presented. In the case of FIG. 7, a flip-up slide shelf 58 is attached to one side of workstation 10 as an accessory. Slide shelf 58 is supported by a strut 64. A slot 65 is provided for allowing strut 64 to move shelf 58 to the extended position as shown in FIG. 7. Strut 64 is slidably mounted within slot 65 using a mount 63. In the FIG. 8 embodiment, an accessory drawer is designed and sized to hold a central processing unit (CPU) of a computer system, or another accessory, such as a small printer. Referring now to FIG. 9, the drawers 54, 56 and 60 in this embodiment are designed to accept a CPU, a printer and other accessories, respectively. The preferred drawer sizes are as follows: top H6"×W19"×D5¾"; middle H6"×W19"×D7¾"; and, bottom H9"×W19"×D17". If desired, the added drawers can be used for the storage of articles that are used for various purposes in a particular work setting. The addition of such drawers enables the user to customize workstation 10 according to that particular user's needs. Each drawer, including keyboard drawer 20 (FIG. 1), includes a handle 68 to facilitate opening and closing. In addition, each drawer can also include a lock to enable its contents to be secured within cabinet 12. In the embodiment shown in FIG. 15, an optional CPU support module 75 is welded or otherwise attached to the outer surface of-side 50 of workstation 10. CPU support 75 preferably has a rectangular opening 76 that is sized to hold a conventional personal computer central processing unit.

Figure 10:
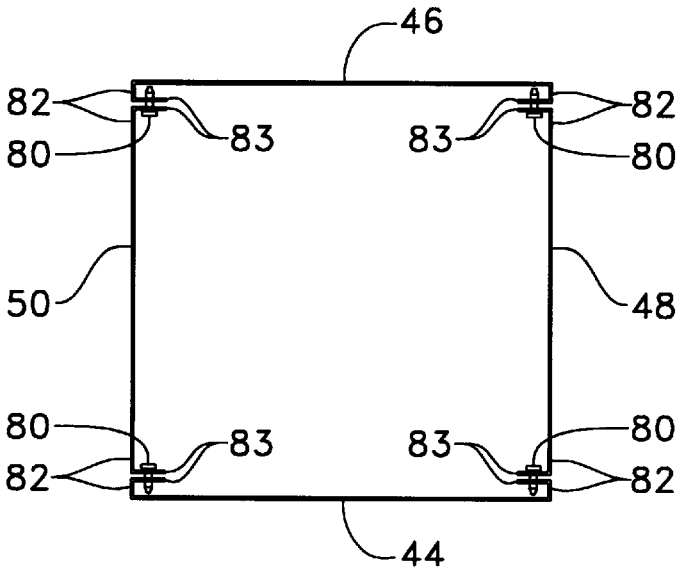
FIG. 10 is a horizontal sectional view along line 10—10 of FIG. 1, showing how the sides of the cabinet of the computer workstation are fastened together.
Figure 11:
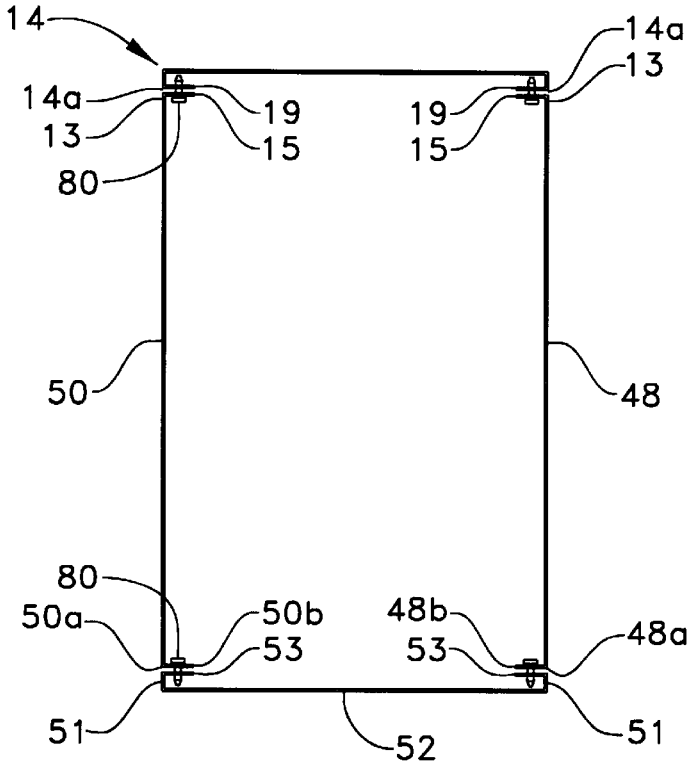
FIG. 11 is a vertical sectional view along line 11—11 of FIG. 1, showing how the window assembly and base are attached to the sides of the cabinet.
Figure 12:
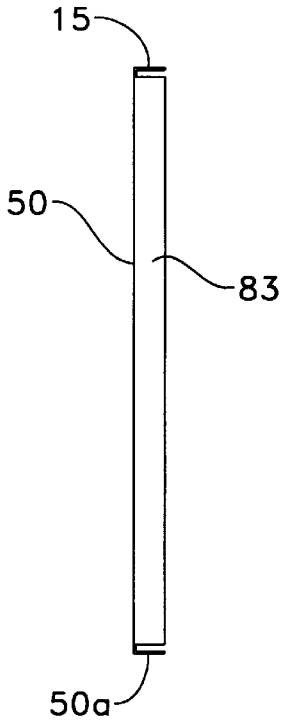
FIG. 12 is a front view of a left side panel of the cabinet of the computer workstation according to one aspect of the present invention.

Referring now to FIGS. 10–12, the preferred modular panel construction of cabinet 12 is illustrated. In the preferred embodiment, the fasteners that are used to connect window assembly 14 to cabinet 12 and to connect sides 44, 46, 48, 50 and base 52 are concealed inside so that cabinet 12 can present a smooth, catch-free outer surface. An example of such a fastener is screw 80. In the preferred embodiment, side edges 82 of each side panel 44, 46, 48 and 50 are bent inwardly as shown in FIG. 10 to form flanges 83, and these flanges are connected together using screws 80. As seen in FIG. 11, top edges 13 of right and left sides 48 and 50 are also bent inwardly to form flanges 15, the bottom edge 14*a* of window assembly 14 is also bent inwardly to form flange 19. The bottom edges 48*a* and 50*a* of right and left sides 48 and 50 are also bent inwardly to form flanges 48*b* and 50*b*.The top edge 51 of base 52 is bent inwardly to form flange 53. Flanges 15 and 19, as well as flanges 48*b*, 50*b* and 53 are connected using screws 80. FIG. 12 is a front view of left side 50 exploded away from cabinet 12 to show the relationship between flanges 15 and 50*b* and flange 83. By concealing the fasteners within cabinet 12, the outer rectangular box surface of cabinet 12 can be substantially smooth and catch-free in order to make the movement and positioning of workstation 10 less cumbersome and less hazardous. Those skilled in the art will appreciate that other methods of constructing could be utilized in order to accomplish the same goal, such as by welding, using smooth headed fasteners exposed on the outer surface, etc.

Figure 13B:
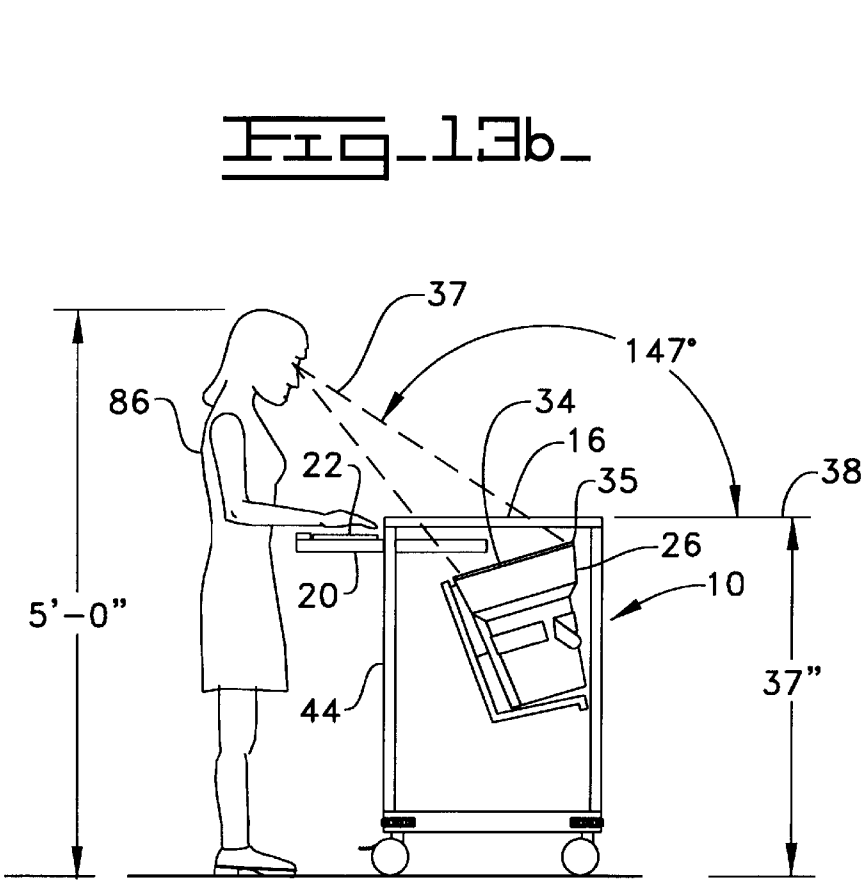
FIGS. 13*a* and 13*b* are side views of tall and short persons, respectively, ergonomically using the computer workstation according to one aspect of the present invention.
Figure 13A:
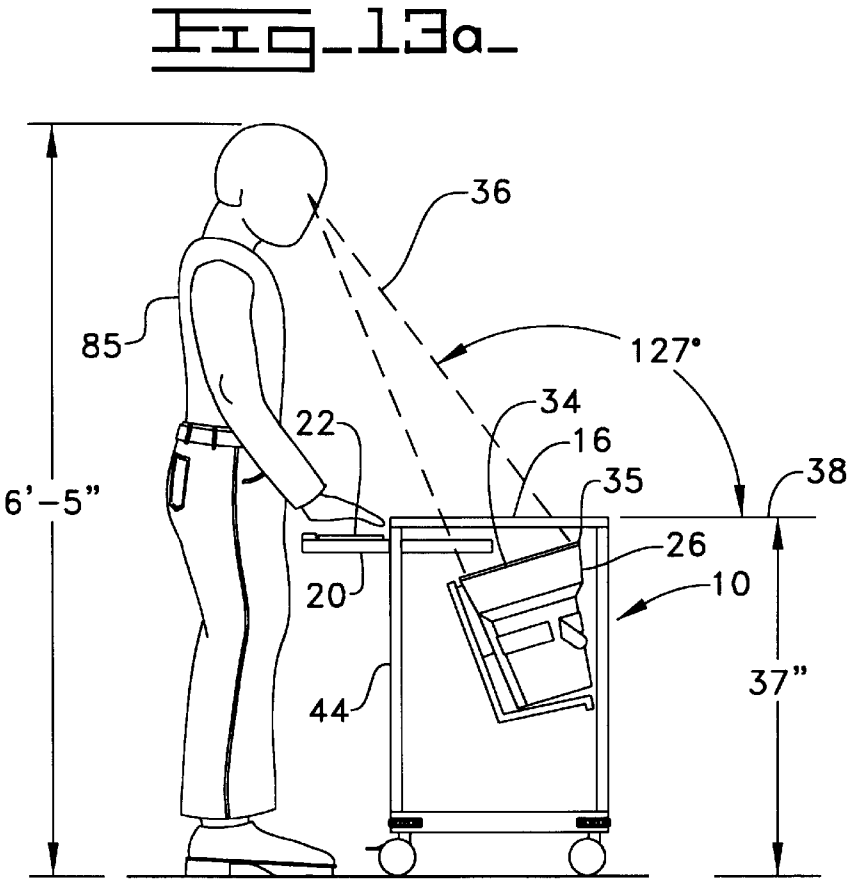
Figure 14:
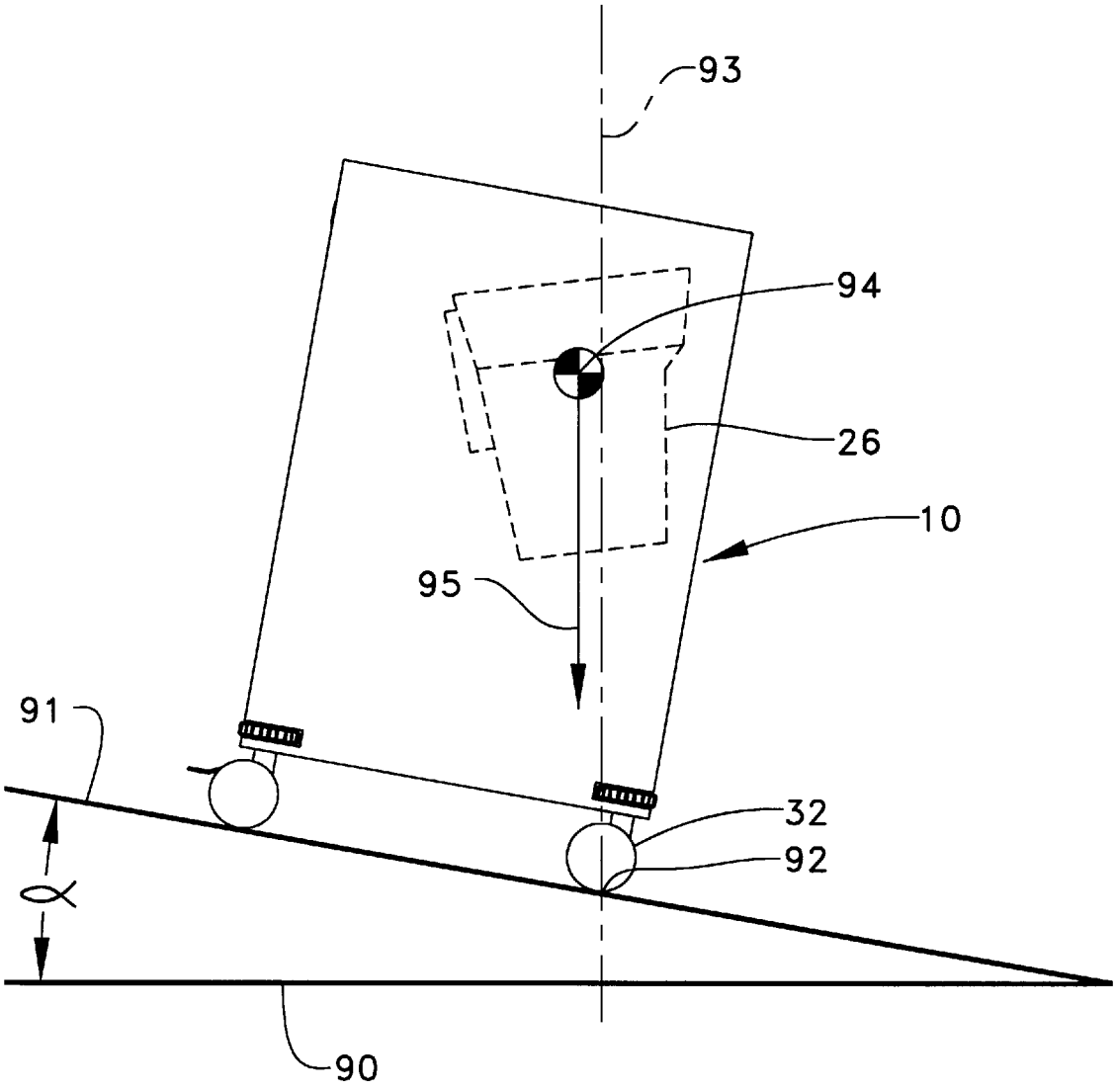
FIG. 14 is a side view of a computer workstation according to the present invention positioned on an inclined plane.
Figure 15:
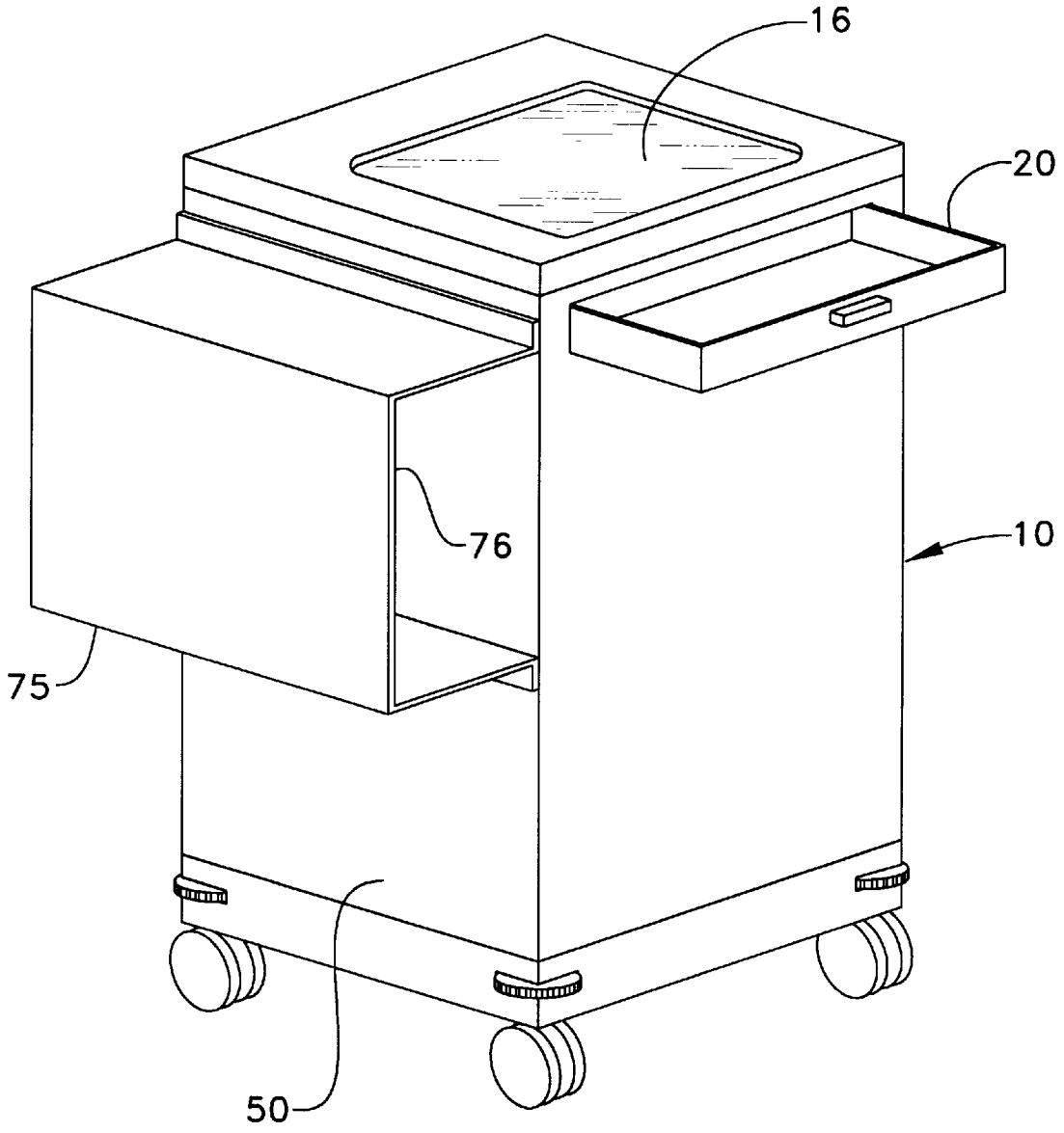
FIG. 15 is a perspective view of a computer workstation according to another embodiment of the present invention.

Referring now to FIGS. 13*a*, 13*b* and FIG. 14, the ergonomic and stability features of workstation 10 are better illustrated. Workstation 10 is preferably sized and designed for comfortable use by a standing person positioned adjacent front side 44. In the preferred embodiment, workstation 10 is taller than wide, and has a height of about thirty-seven inches, a width of about twenty-one and a half inches and a depth of about twenty-one and a half inches. However, it has been found that the ergonomics of workstation 10 can be maintained provided that the top of cabinet 12 is less than about forty-two inches above the ground. The dimensions of workstation 10 allow it to occupy less than about three and a half square feet of floor space when the keyboard drawer 20 is in its concealed position. Workstation 10 preferably has a relatively low center of gravity 94 so that the same is stable when stationary on an inclined plane or being pushed in transit over a smooth and/or irregular surface. In the preferred embodiment, when workstation 10 is stationary on an inclined plane 91 that is at a slope angle alpha with respect to a horizontal line 90, workstation 10 will not tip over. This is accomplished by positioning the center of gravity 94 such that the gravitational weight 95 of workstation 10 is positioned on the stable side of vertical stability line 93. Vertical stability line 93 is an imaginary line that runs parallel to gravity and intersects the contact point 92 where the lower caster 32 comes in contact with inclined plane 91. This contact point 92 is the point about which workstation 10 would tend to rotate if it were to tip over. One skilled in the art can easily appreciate that if the center of gravity 94 of workstation 10 were positioned on the right-hand side of vertical stability line 93, workstation 10 would tip over when stationary on an inclined plane 91. In the preferred embodiment, workstation 10 is preferably stable in this sense when stationary on an inclined plane having a slope angle up to about 10°.

Referring now specifically to FIGS. 13*a* and 13*b*, workstation 10 can preferably ergonomically accommodate both a tall person 85, which is about six feet five inches tall, or a short person 86, which is about five feet tall. It has been found that both tall and short persons can comfortably use keyboard 22 when standing if the keyboard is positioned between about thirty-four and thirty-eight inches above the ground. In the preferred embodiment, keyboard support 20 is positioned about thirty-six inches above the ground or other cabinet support surface. It is important that both a tall person 85 and a short person 86 can see the entire view screen 34 of computer monitor 26 comfortably when standing adjacent front side 44 as shown in FIGS. 13*a* and 13*b*. This has been accomplished by positioning monitor 26 with respect to window 16 such that the top edge 35 of view screen 34 is visible at or less than an angle of about 147° with respect to a horizontal line 38. With this construction, a relatively short person 86 has a line of sight 37 at an angle of about 147° with respect to a horizontal line 38, and can thus see the entire view screen 34 without bending or straining in any way. In addition, a tall person 85 as shown in FIG. 13*a* has a line of sight 36 to the top edge 35 of view screen 34 at an angle of about 127° with respect to a horizontal line 38. Thus, a tall person 85 as well as a short person 86 can use keyboard 22 and see the entire view screen 34 while standing in a relatively comfortable position.

Those skilled in the art will appreciate that numerous modifications and alternative embodiments of the present invention will be apparent in view of the foregoing description. Accordingly, this description is to be construed as illustrative only and is for the purpose of teaching those skilled in the art the best mode of carrying out the invention. The details of the structure may be varied substantially without departing from the spirit of the invention, the scope of which is defined in terms of the claims as set forth below.

I claim:

1. A computer workstation comprising:

a cabinet being taller than wide and having a top that includes an angularly fixed horizontal substantially leak-proof window;

a computer monitor mounted in, and surrounded by, said cabinet and being positioned under said window;

a computer input device supported by an input support portion of said cabinet and being moveable between a concealed position inside said cabinet and an exposed position, and said computer input device being inaccessible and protected from outside contaminants when said input support portion is in said concealed position; and a front side of said cabinet which includes said input support portion being about equal in vertical surface area to a rear side of said cabinet.

2. The computer workstation of claim 1 wherein said computer input device being positioned adjacent said front side at an ergonomic height between about 34 and 38 inches above a cabinet support surface when in said exposed position.

3. The computer workstation of claim 2 wherein said computer monitor has a view screen with a top edge; and said top edge of said view screen is visible to a standing person that is between 5 feet and 6 feet 5 inches tall through said substantially leak-proof window at an ergonomic angle less than about 147 degrees with respect to a horizontal line.

4. The computer workstation of claim 3 wherein said top of said cabinet is ergonomically less than about 42 inches above said cabinet support surface.

5. The computer workstation of claim 4 wherein said ergonomic height is about 36 inches; and said top of said cabinet is ergonomically about 37 inches above said cabinet support surface.

6. The computer workstation of claim 1 further comprising a plurality of casters attached to a bottom of said cabinet; and said computer workstation having a center of gravity located at a position such that said computer workstation will remain upright when stationary on a sloped surface having a slope angle less than about 10 degrees with respect to a horizontal line.

7. The computer workstation of claim 1 wherein said computer input device includes a keyboard; and said keyboard is positioned lower than said top and higher than a portion of a view screen of said computer monitor when in both said concealed position and said exposed position.

8. The computer workstation of claim 1 further comprising a CPU support attached to one side of said cabinet; and said CPU support being sized to hold a personal computer central processing unit.

9. A computer workstation comprising:

a rectangularly shaped cabinet being taller than wide and having a bottom and a top that includes an angularly fixed horizontal substantially leak-proof window;

a plurality of casters attached to said bottom of said cabinet a computer monitor mounted in, and surrounded by, said cabinet and being positioned under said window;

a computer input device supported by an input support portion of said cabinet and being moveable between a concealed position inside said cabinet and an exposed position, and said computer input device being inaccessible and protected from outside contaminants when said input support portion is in said concealed position; and said computer workstation occupies less than about 3½ square feet of floor space when said computer input device is in said concealed position.

10. The computer workstation of claim 9 wherein said computer workstation has a center of gravity located at a position such that said computer workstation will remain upright when stationary on a sloped surface having a slope angle less than about 10 degrees with respect to a horizontal line.

11. The computer workstation of claim 10 wherein said cabinet has a front side; and said computer input device being positioned adjacent said front side at an ergonomic height between about 34 and 38 inches above a cabinet support surface when in said exposed position.

12. The computer workstation of claim 11 wherein said computer monitor has a view screen with a top edge; and said top edge of said view screen is visible to a standing person that is between 5 feet and 6 feet 5 inches tall through said substantially leak-proof window at an ergonomic angle less than about 147 degrees with respect to a horizontal line.

13. The computer workstation of claim 12 wherein said top of said cabinet is ergonomically less than about 42 inches above said cabinet support surface.

14. The computer workstation of claim 13 wherein said ergonomic height is about 36 inches; and said top of said cabinet is ergonomically about 37 inches above said cabinet support surface.

15. The computer workstation of claim 14 wherein said computer input device includes a keyboard; and said keyboard is positioned lower than said top and higher than a portion of said view screen of said computer monitor when in both said concealed position and said exposed position.

16. A computer workstation comprising:

a rectangularly shaped cabinet being taller than wide and having an exterior, a bottom and a top that includes an angularly fixed horizontal substantially leak-proof window;

a plurality of lockable casters having a diameter greater than about 2½ inches attached to said bottom of said cabinet;

a plurality of bumpers attached to said exterior of said cabinet;

a computer monitor mounted in, and surrounded by, said cabinet and being positioned under said window;

a computer input device supported by an input support portion of said cabinet and being moveable between a concealed position inside said cabinet and an exposed position, and said computer input device being inaccessible and protected from outside contaminants when said input support portion is in said concealed position;

said computer workstation occupies less than about 3½ square feet of floor space when said computer input device is in said concealed position; and said exterior of said cabinet presents a smooth, catch-free surface when said computer input device is in said concealed position.

17. The computer workstation of claim 16 wherein said computer workstation has a center of gravity located at a position such that said computer workstation will remain upright when stationary on a sloped surface having a slope angle less than about 10 degrees with respect to a horizontal line.

18. The computer workstation of claim 17 wherein said cabinet has a front side;

said computer input device being positioned adjacent said front side at an ergonomic height between about 34 and 38 inches above a cabinet support surface when in said exposed position;

said computer monitor has a view screen with a top edge; and said top edge of said view screen is visible to a standing person that is between 5 feet and 6 feet 5 inches tall through said substantially leak-proof window at an ergonomic angle less than about 147 degrees with respect to a horizontal line.

19. The computer workstation of claim 18 wherein said ergonomic height is about 36 inches; and said top of said cabinet is ergonomically less than about 42 inches above said cabinet support surface.

20. The computer workstation of claim 19 wherein said top of said cabinet is ergonomically about 37 inches above said cabinet support surface.

* * * * *